United States Patent [19]

Pounds

[11] Patent Number: 4,468,542

[45] Date of Patent: Aug. 28, 1984

[54] KEYBOARD ASSEMBLY

[75] Inventor: Walter R. Pounds, Lafayette, Colo.

[73] Assignee: KB Denver, Inc., Frederick, Colo.

[21] Appl. No.: 494,958

[22] Filed: May 16, 1983

[51] Int. Cl.[3] ..... H01H 13/70

[52] U.S. Cl. ..... 200/5 A; 200/159 B; 200/306; 200/340

[58] Field of Search ..... 200/5 R, 5 A, 159 B, 200/292, 306, 302.1-302.3, 340

[56] References Cited

U.S. PATENT DOCUMENTS

| | | | |
|---|---|---|---|
| 3,707,609 | 12/1972 | Dapot et al. | 200/5 A X |
| 3,749,859 | 7/1973 | Webb et al. | 200/5 A X |
| 3,806,673 | 4/1974 | Boulanger | 200/5 A |
| 3,842,230 | 10/1974 | Kashio et al. | 200/5 A X |
| 3,898,421 | 8/1975 | Suzumura | 200/159 B |
| 4,033,030 | 7/1977 | Robinson et al. | 200/5 A X |
| 4,046,975 | 9/1977 | Seeger, Jr. | 200/5 A |
| 4,156,802 | 5/1979 | Gilano et al. | 200/5 A |
| 4,164,634 | 8/1979 | Gilano | 200/5 A |
| 4,354,077 | 10/1982 | McMains | 200/314 |

*Primary Examiner*—J. R. Scott

*Attorney, Agent, or Firm*—Lee, Smith & Zickert

[57] ABSTRACT

A keyboard assembly including a plurality of key operated switches, each of which includes a dome associated with contacts on a printed circuit board which when triggered upon being subjected to a triggering force closes the switch and upon being released opens the switch and a keycap or push button for operating the dome and a transmission system for transmitting a force from the keycap to the dome which includes an actuator extending from the keycap and a conically shaped helical spring between the actuator and the dome with the small end of the spring in working engagement with the dome. The underside of the dome is vented to the atmosphere through a vent in the printed circuit board which is sealed against contamination of dust by a perforated adhesive backed plastic film or sheet over the underside of the printed circuit board.

11 Claims, 4 Drawing Figures

SPACE
CAPS
TAB

KEYBOARD ASSEMBLY

DESCRIPTION

This invention relates in general to a keyboard assembly, and more particularly to a keyboard assembly having a plurality of key operated switches, each of which includes a dome associated with contacts on a printed circuit board and an improved transmission system for applying an operating force to the dome, and still more particularly to an improved key operated switch for a keyboard having a dome that is vented to the atmosphere and sealed against dust contamination.

BACKGROUND OF THE INVENTION

Keyboard assemblies of various types are well known including those which employ key operated switches utilizing domes in association with contacts on a printed circuit board such as illustrated in U.S. Pat. No. 3,967,084. It has also been known to provide force transmission systems to operate dome switches which utilize helical spring members between the keycap or push button and the dome, such as illustrated in U.S. Pat. No. 4,156,802. It has also been known to provide keyboard assemblies with dome switches which are constructed to prevent air from being trapped at the underside of the dome and to inhibit dust contamination of the contacts, such as illustrated in U.S. Pat. No. 3,898,421.

Heretofore known force transmission systems as above referred to have been overly complex in that they have included a large number of parts, and it has been difficult to control the force needed to operate the domes. Also, heretofore known keyboard assemblies which include arrangements where the domes do not trap air at their undersides have been constructed to include a number of elements and/or have otherwise been unsatisfactory. For example, where it is intended to prevent dust contamination in the assembly disclosed in above U.S. Pat. No. 3,898,421, the dust filter has not been altogether satisfactory to properly protect the contact surfaces for the domes. Dust contamination leads to switch malfunction. The arrangement in U.S. Pat. No. 4,033,030 utilizes a layer of foam material for allowing air movement behind the domes, which foam material upon aging can disintegrate and contaminate the contacts.

SUMMARY OF THE INVENTION

The present invention overcomes the difficulties heretofore known in the prior art in providing a keyboard assembly having a plurality of key operated or push button operated switches having a unique force transmission system defining a full-stroke, high-speed data entry keying device. The force transmission system is constructed of a minimum number of parts for providing an operating force to a dome switch in that it merely requires an actuator and a spring where the spring bottoms at one end on the actuator and at the other end on the dome. The spring is helically formed and conically shaped with the small end being in working engagement with the dome. The dome trip force requirement is adjustable by varying the size of the small end of the spring. A keycap or push button may be integrally formed with the actuator or formed for removable mounting thereon. A retainer coacts with the actuator to limit its movement away from the dome. The force transmission system is set up so that the spring is maintained under compression to apply a force to the dome less than the tripping force of the dome but of a magnitude such that slight movement of the actuator will cause the dome to trip.

Another feature of the keyboard assembly of the present invention is in the construction of the printed circuit board so that the underside of the domes are vented to the atmosphere but yet protected against dust contamination. A venting hole is provided in the printed circuit board in alignment with the dome and the underside of the board is covered with an adhesive backed perforated plastic film or sheet which includes perforations that will allow the flow of air but which will prevent the passage of dust and thereby prevent contamination of the contacts.

It is therefore an object of the present invention to provide a new and improved keyboard assembly having a plurality of key operated dome switches actuated by a transmission system such that operation of each switch may be accomplished by a long stroke which permits overtravel of the depressed key.

A further object of the present invention is in the provision of the keyboard assembly having an improved transmission system for operating dome switches which includes a spring member and which has a minimum number of parts but is highly reliable.

Another object of the present invention is in the provision of an improved force transmission system for a key operated dome switch including a conically shaped helical spring, the design of which may be varied to increase or decrease the dome trip force requirement.

Another object of the present invention is in the provision of a keyboard assembly including a plurality of key operated dome switches wherein the underside of the domes are vented to the atmosphere but are protected against dust contamination by a perforated adhesive backed plastic film.

Other objects, features and advantages of the invention will be apparent from the following detailed disclosure, taken in conjunction with the accompanying sheets of drawings, wherein like reference numerals refer to like parts, in which:

DESCRIPTION OF THE PREFERRED EMBODIMENT

Figures 1, 2, 3, 4:
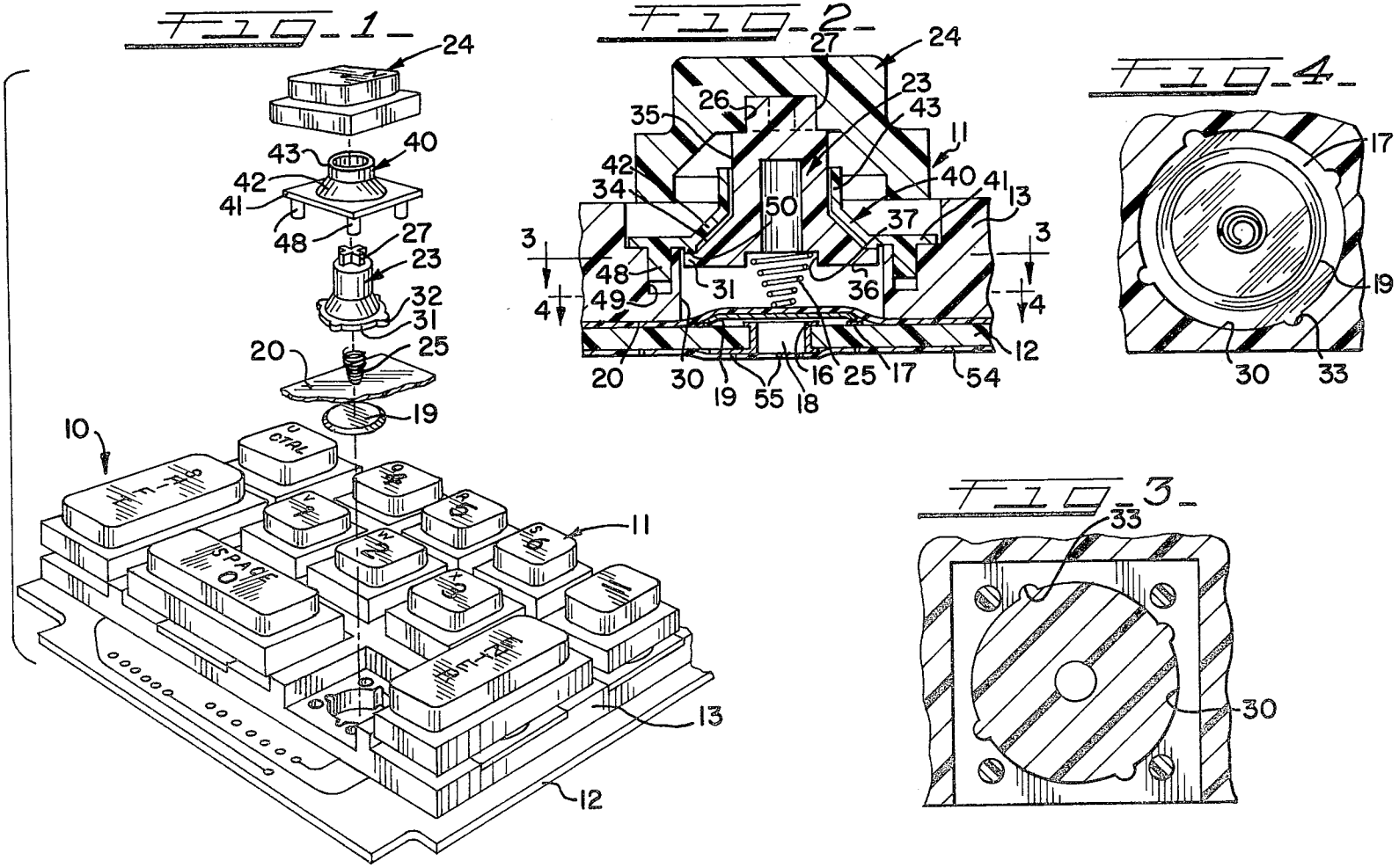
FIG. 1 is a fragmentary perspective view of a keyboard assembly according to the invention showing one key operated switch in an exploded view.
FIG. 2 is a vertical section view taken through a key operated switch on the keyboard assembly shown in FIG. 1.
FIG. 3 is a longitudinal sectional view taken through the key operated switch of FIG. 2 and generally along line 3—3 thereof.
FIG. 4 is a longitudinal sectional view taken through the key operated switch of FIG. 2 and generally along line 4—4 thereof.

Referring now to the drawings, a keyboard assembly according to the present invention and generally designated by the numeral 10, includes a plurality of key operated dome switches 11, each of which is the same with the exception that they may include keycaps of different sizes and with different legends. The assembly includes a printed circuit board 12 having a plurality of switch sites thereon. A panel 13 is suitably secured to the printed circuit board and includes a plurality of openings aligned with each of the switch sites on the printed circuit board for guidably receiving the actuators of the switches. The panel 13 is made of a suitable plastic material which is electrically insulative.

Each switch site on the printed circuit board 12 includes switch contacts 16 and 17. The contact 16 is at a plated-through hole in the circuit board forming a vent hole 18 in the board and also aligned axially with the center of a dome 19 of a suitable stainless steel or the like positioned at the switch site. The dome switching assembly is of a type like that shown in the above U.S. Pat. No. 3,967,084. The periphery of the dome rests on and is in engagement with the contact 17 at all times and upon tripping of the dome the center part of the dome then engages the contact 16 to close the switch. Release of the dome thereafter allows the switch to open. As is well known the contacts are connected to suitable conductors on the top and bottom sides of the printed circuit board and then to suitable terminals at one end of the board for further connection to circuits. A non-porous adhesive backed plastic film 20, such as Mylar, overlies the domes and the circuit board and maintains them in position at the switch sites in a manner well known. The plastic film not only seals the domes and the top side of the board against contamination, but it also electrically insulates the domes and top side of the board from elements thereover.

The key-operated dome switches 11 include in combination with the domes an actuator or switch plunger 23 of a suitable plastic, a keycap or push button 24 of a suitable plastic and a spring 25.

The keycap 24 may take any suitable form such as shown where it is relatively square although elongated rectangular keycaps are also illustrated on the keyboard 10. Any suitable legend may be applied to the top surface of the keycap and the keycap 24 may be interchangeable with a keycap of another legend inasmuch as it includes at its underside a socket 26 mating in a frictionfit relation with a fitting 27 formed on the upper end of the actuator 23.

The actuator 23 is vertically movable within a cylindrical wall 30 formed in the panel 13 and, accordingly, includes a cylindrically shaped base portion 31 having a plurality of peripheral guide bars or lugs 32 extending vertically and in slidable mating relation with vertical guide channels 32 formed in the cylindrical wall 30 and which prevent rotational movement of the actuator relative to the cylindrical wall 30. Upwardly of the base portion 31, the actuator is necked down and includes a frusto-conically shaped portion 34 and extending from the upper end thereof is a cylindrically shaped upper guide portion 35. The keycap fitting 27 extends from the upper end of the upper guide portion 35.

At the bottom surface 36 of the actuator and centrally thereof is a recessed spring seat 37 against which the upper end of the spring 21 is fitted and held against lateral movement relative to the actuator. The lower smaller end of the conically shaped spring 25 is in working engagement with the dome 19 and engages the dome at the center thereof, as seen particularly in FIG. 4.

The lower or smaller end of the spring 25 is critically sized relative to the dome 19 in order to define the desired dome trip force requirement. The dome collapses upon being tripped and closes the switch. An increase in diameter of the lower end of the spring causes a proportional increase in the dome trip force requirement. Likewise, a decrease in diametrical size causes a decrease in the dome trip force requirement.

The actuator is limited in its upward movement by means of a combination retainer and guide member 40 which is suitably secured to the panel 13. As seen particularly in FIGS. 1 and 2, the retainer and guide member 40 includes a square base plate 41 which is centrally open and provided with an upwardly extending frusto-conical wall 42 and upward therefrom a circular shaped wall 43. The actuator 23 in its upward position has its upper guide portion 35 freely extending through the circular wall 43, while the frusto-conical portion 34 freely fits in the frusto-conical wall 42. The circular wall 43 coacts with the cylindrical portion 35 to guide the upper end of the actuator vertically relative to the keyboard, while the base 31 guides the lower end of the actuator relative to the cylindrical wall 30 and the panel 13. The retainer and guide 40 includes downwardly extending pegs or posts 48 at each of the corners of the retainer and guide 40. The posts 48 frictionally fit into sockets 49 formed in the panel 13. If desired, the posts may be permanently cemented or otherwise secured to the panel 13. In order to prevent the actuator from binding in the retaining and guiding plate, an annular stop 50 is formed at the underside of the base plate 41 against which the base portion 31 of the actuator abuts when in the home position, as illustrated in FIG. 2, and thereby which prevents the actuator from sitting on the walls 42 and 43 of the retainer and guide member 40.

The spring 25 is sized so that when it is in mounted position within the key operated switch, it is under compression which applies a force against the dome but of a magnitude less than the triggering force and of a magnitude that will cause triggering of the dome or collapse of the dome to close the switch upon a small movement of the actuator in a downward position. Thereafter, further movement is taken up by the spring 25 and which therefore defines an overtravel condition for the actuator without further affecting the operation of the dome.

It can be appreciated that the transmission system for delivering a tripping force to the dome merely consists of the actuator 23 and the spring 25 as the keycap is merely an extension of the actuator. This reduces the overall number of parts needed to provide the improved force transmission system of the present invention.

At the underside of the printed circuit board 12, a porous dust seal 54 prevents dust contamination of the dome contacts and also permits the venting of the underside of the dome to atmosphere so that no air becomes trapped at the underside of the dome which would inhibit dome operation. The dust seal 54 is in the form of an adhesive backed perforated plastic film or sheet and preferably Transpore tape made by 3M Company. This tape is a perforated ethylene/vinyl acetate coated with an acrylic based adhesive and is perforated on 0.040 inch centers, as generally indicated by the numeral 55. While permitting air flow, it prevents the passage of dust and therefore prevents contamination of the switch contacts.

In operation, a switch is closed by depressing a keycap. The force against the keycap is transmitted by the actuator or switch plunger to the conically shaped spring and to the dome. The initial movement of the keycap sets up a trip force in the spring to the dome and closes the switch. Further stroking of the keycap causes overtravel that is absorbed by the force transmission system of the assembly. Because the spring is conically formed and seated at its larger end against lateral movement, it will not buckle upon actuation and thereby provide a high degree of reliability.

It will be understood that modifications and variations may be effected without departing from the scope of the novel concepts of the present invention, but it is understood that this application is to be limited only by the scope of the appended claims.

The invention is hereby claimed as follows:

1. In a keyboard assembly having a plurality of key operated switches, wherein each switch includes a dome mounted on a printed circuit board in association with switch contacts that are closed upon tripping the dome and opened upon releasing the dome, a keycap adapted to be engaged for actuating said dome, and a transmission system between the keycap and dome for transmitting a force applied on the keycap to the dome, the improvement being in said transmission system which includes an actuator on which the keycap is mounted, and a conically shaped coil spring bottoming at one end on the actuator and at the other end on the dome with the smallest end of the spring in working engagement with the dome.

2. In a keyboard assembly as defined in claim 1, wherein said actuator includes a recess in which the largest end of the spring is seated and held against lateral movement.

3. In a keyboard assembly as defined in claim 1, wherein the longitudinal axis of said spring is axially aligned with the longitudinal axes of said actuator and dome.

4. In a keyboard assembly as defined in claim 1, wherein means is provided to limit the movement of said actuator away from said dome such that said spring is maintained under compression to apply a force to the dome less than the tripping force thereof, but of such a magnitude that upon slight movement of the actuator, the tripping force will be generated in the spring.

5. In a keyboard assembly as defined in claim 1, wherein said keycap is removably mounted on said actuator.

6. In a keyboard assembly as defined in claim 2, wherein the longitudinal axis of said spring is axially aligned with the longitudinal axes of said actuator and dome.

7. In a keyboard assembly as defined in claim 3, wherein means is provided to limit the movement of said actuator away from said dome such that said spring is maintained under compression to apply a force to the dome less than the tripping force thereof, but of such a magnitude that upon slight movement of the actuator, the tripping force will be generated in the spring.

8. In a keyboard assembly having a plurality of key operated switches, wherein each switch includes a dome mounted on a printed circuit board in association with switch contacts that are closed upon tripping the dome and opened upon releasing the dome, vent means in said printed circuit board communicating with the underside of said dome, means on the backside of said board covering said vent means, a keycap adapted to be engaged for actuating said dome, and a transmission system between the keycap and dome for transmitting a force applied on the keycap to the dome, the improvement being in said covering means which includes a sheet of adhesive backed, perforated plastic that is perforated such as to prevent dust contamination of said switch contacts and to allow the underside of said dome to be vented to the atmosphere.

9. In a keyboard assembly as defined in claim 8, wherein said perforated plastic consists of an ethylene/-vinyl acetate with an acrylic-based adhesive and is perforated on 0.040 inch centers.

10. In a keyboard assembly as defined in claim 8, the improvement further being in said transmission system which includes an actuator on which the keycap is mounted, and a conically shaped coil spring bottoming at one end on the actuator and at the other end on the dome with the smallest end of the spring in working engagement with the dome.

11. In a keyboard assembly as defined in claim 10, wherein means is provided to limit the movement of said actuator away from said dome such that said spring is maintained under compression to apply a force to the dome less than the tripping force thereof, but of such a magnitude that upon slight movement of the actuator, the tripping force will be generated in the spring.

* * * * *